US006443752B1

(12) United States Patent
Kosawa

(10) Patent No.: US 6,443,752 B1
(45) Date of Patent: Sep. 3, 2002

(54) TERMINAL

(75) Inventor: Makoto Kosawa, Kanagawa (JP)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/706,653

(22) Filed: Nov. 6, 2000

(30) Foreign Application Priority Data

Nov. 4, 1999 (JP) ..... 11-314431

(51) Int. Cl.[7] ..... H01R 13/625
(52) U.S. Cl. ..... 439/342; 439/858
(58) Field of Search ..... 439/342, 83, 856, 439/857, 858, 259, 861

(56) References Cited

U.S. PATENT DOCUMENTS 6,056,576 A * 5/2000 Szu ..... 439/342
6,095,842 A 8/2000 Lin ..... 439/342
6,113,412 A * 9/2000 Lin ..... 439/342

* cited by examiner

*Primary Examiner*—Tho D. Ta
(74) *Attorney, Agent, or Firm*—Woodcock Washburn LLP

(57) ABSTRACT

In a terminal formed in a housing on which an electrical part is mounted, set in an opening that receives the pin projecting from this electrical part, and connecting the pin inserted into this opening by mounting this electrical part on this housing, defective connections between the terminal and substrate due to force transmitted to the terminal is prevented. The terminal of the present invention provides a supporting part on the housing, an engaging part formed at the end side of the supporting part and engaging with the pin, and a branched part that branches form the sides if the supporting part and is connected to the substrate on which the housing is mounted.

8 Claims, 2 Drawing Sheets

TERMINAL

FIELD OF THE INVENTION

The present invention relates to a terminal and a support structure therefor used for example in sockets for freely-detachably mounting an electrical component such as a CPU on a substrate.

BACKGROUND OF THE INVENTION

PGA (Pin Grid Array)-type sockets, which are called LIF (Low Insertion Force) or ZIF (Zero Insertion Force) sockets, are used when freely-detachably mounting on a substrate an electrical component such as a CPU is desired. This type of socket has a flat shaped housing with a plurality of openings formed on the surface thereof, and a cover plate that covers the surface of the housing and that has a plurality of through holes formed thereon communicating with the openings. In addition, in the openings, metallic terminals are respectively installed.

When installing the electrical part, for example, the electrical part is mounted on the cover plate, and the pins projecting from the electrical part are inserted into the openings via the through holes. At this point, the pins are positioned at one side of the terminals, and both are separated. Next, when the cover plate is moved in the direction towards the other side along the surface of the housing, the pins in the openings contact the terminals by being pushed in the direction towards the other side by the cover plate, and the pins connect to the terminals. When removing the electrical part, the cover plate is moved in the first direction, and after the terminals are separated from the pins, the pins are extracted from the openings and the through holes.

However, in the conventional terminal described above, because the engaging part is directly formed on the end of the supporting part, the force acting on the engaging part, when the above pin is attached to or released from the engaging part, and the stress produced on the engaging part, when the engaged with the pin is transmitted directly to the supporting part, and as a result, cracks form in the welds that anchor the supporting part and the substrate, and there is the concern that damage will occur to the connection between the terminal and the substrate. In consideration of this problem, an object of the present invention is to prevent the occurrence of defective connections between the terminal and the substrate due to force transmitted to the terminal.

SUMMARY OF THE INVENTION

The present invention is a terminal formed on a housing on which an electrical part is mounted, fixed in the opening that receives one of the pins projecting from this electrical part, and connected to this pin inserted in this opening while the electrical part is mounted on this housing, characterized in comprising a supporting part on the housing, an engaging part that is formed on the end side of the supporting part and engages with the pin, and a branched part that branches from a side of the supporting part and connects with a substrate that supports this housing.

Here, this engaging part is preferably formed at the end of a connecting part, which is formed by bending the end of the supporting part. In addition, further preferably, the side surface of the supporting part opposite to the curved side of the bending part abuts the wall of said opening.

BRIEF EXPLANATION OF THE FIGURES

The foregoing summary, as well as the following detailed description of the preferred embodiments, is better understood when read in conjunction with the appended drawings. For the purpose of illustrating the invention, there is shown in the drawings embodiments that are presently preferred, it being understood, however, that the invention is not limited to the specific apparatus, system, and instrumentalities disclosed. Below, the embodiments of the invention will be explained referring to the figures in which.

DETAILED DESCRIPTION OF THE PREFERRED EMBODIMENTS

Figure 1:
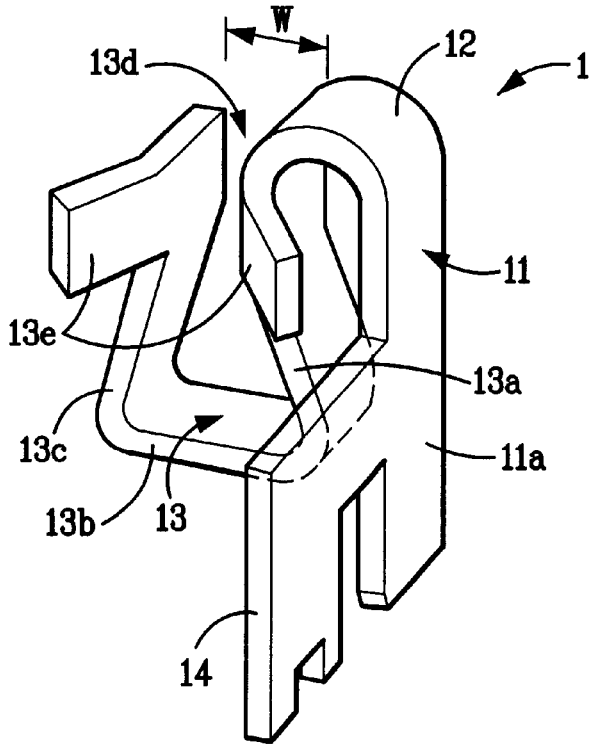
FIG. 1 is an upper perspective drawing showing an example of the structure of the terminal according to the present invention.

An example of the structure of the terminal according to the present invention is shown in FIG. 1. The terminal 1 is formed in a specified shape after being punched from a metal plate by pressing, for example, and comprises a flat rectangular supporting part 11, a connecting part 12 formed by bending the end (upper edge of the figure) of the supporting part 11, an engaging part 13 formed on the end of the connecting part 12, and a branching part 14 that branches from a side of the supporting part 11.

The connecting part 12 is a concave U-shaped member on the end of the supporting part 11 formed by bending the end towards the base from the underside of the supporting part 11 (left side in the figure) at a specified arc. In addition, the engaging part 13 is a C-shaped member opening at the end and having a side part 13*a* that is formed by extending the end of the connecting part 12 towards the base side, a base part 13*b* that is formed by bending the end of the side part 13*a* towards the side separated from the supporting part 11, and a side part 13*c* formed by bending the end of the bottom part 13*b* towards the end side. The side parts 13*a* and 13*c* gradually approach each other facing the end side, that is, the opening end 13*d* side of the engaging part 13, and the width W between the side parts 13*a* and 13*c* in this opening end 13*d* has a slightly smaller radius than the radius of the terminal (described below) that engages the engaging part 13. In addition, these side parts 13*a* and 13*c* can be elastically deformed in the direction of expansion and contraction of this width W. Reference number 13*e* is a pair of guiding projections positioned opposite to and enclosing opening end 13*d* on sides 13*a* and 13*c*, and respectively project towards the side (the front in the figure) along the side opposite to sides 13*a* and 13*c*, and these guide projections 13*e* are bent so as to separate gradually in such a way that their distance separates from the opening end 13*d*.

The branching part 14 extends from the side end (the end facing the front of the figure) of the supporting part 11 towards the side along the surface 11*a* of the support part 11, and then extends towards the base side. As a result, the branching part 14 branches into an L-shape from the supporting part 11 towards the base side.

Figure 2:
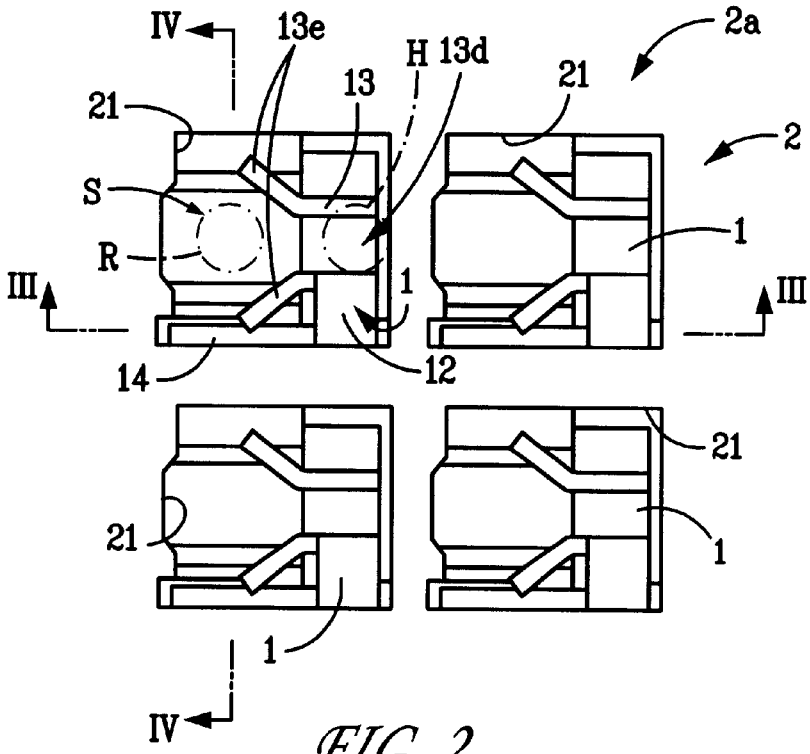
FIG. 2 is an upper view along the arrow I in FIG. 3 showing an example of the terminal mounted on the housing according to the present invention.

The installation of the terminal 1 having the above-described structure to th housing will be explained referring to FIG. 2 through FIG. 4. Reference numeral 2 in the figures is the housing, and on the surface 2*a* of the housing 2 a plurality of openings 21 (only 4 are shown in FIG. 2) are formed conforming to the positions of the pins 3 projecting from the electrical part (not shown) mounted on the housing 2. On the terminal 1, a space S for inserting the terminal 3 is formed at one end of the guiding projections 13*e* in the opening, and in addition, at the other end side in the opening 21 (the right side in FIG. 2 and FIG. 3), the guiding projection 13*a* is installed facing the one end side.

Figure 4:
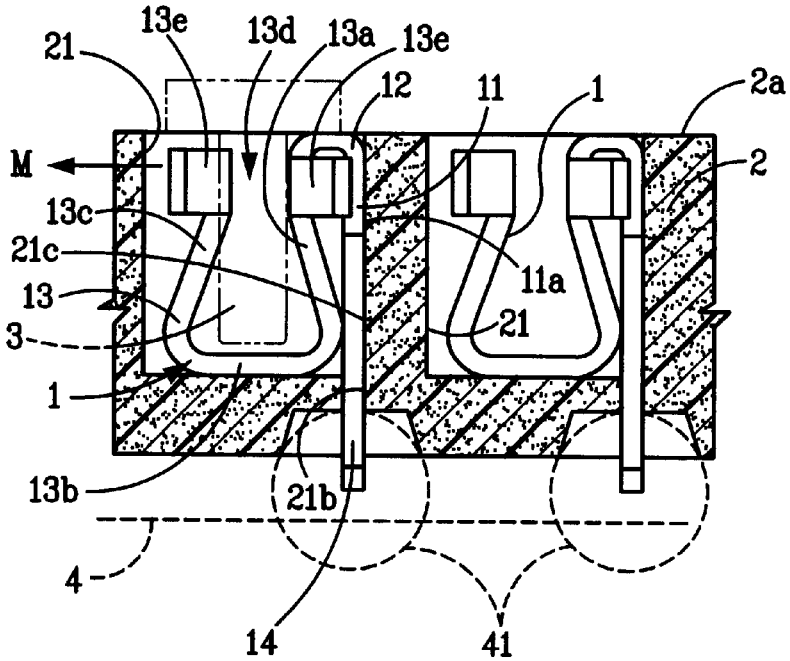
FIG. 4 is a cross-sectional drawing along line IV—IV in FIG. 2 showing an example of the terminal mounted on the housing according to the present invention.

In addition, as shown in FIG. 4, when installing the terminal 1 in the opening 21, the surface 11*a* of the supporting part (the curved side of the connecting part 12 and opposite side surface) abuts the opposite wall 21*c* of the opening 2, and as will be described below, when the pin in the opening end 13*d* of the engaging part 13 is gripped, in the engaging part 13, only the side part 13*c* positioned opposite the connecting part 12 elastically deforms in the outward direction due to being pressed by the pin 3, and its position determined. Concretely, when the pin 3 is gripped in the opening end 13*d,* the side of the pin 3 facing the side part 13*a* positioned at the connecting part 12 side sets the position of the terminal 1 in the opening 21 so as to be positioned at the upper side of the side part 13*a*.

A through hole 21*a* is formed on the bottom of the other end of the opening 21, and a through hole 21*b* is formed at one end side of the through hole 21*a,* Both of the through holes 21*a* and 21*b* pass through the housing 2 and reach the bottom of the housing 2, and in addition, when the terminal 1 is installed into the opening 21, the base of the supporting part 11 and the branched part 14 respectively are inserted into these through holes 21*a* and 21*b*. The supporting part 11 and the edge of the base of the branched part 14 protrude from the bottom of the housing 2 via the through holes 21*a* and 21*b,* and the edge of the base of the branched part 14 is connected, as shown in FIG. 3 and FIG. 4, to the substrate on which the housing 2 is mounted by soldering. That is, in the case of the terminal 1 according to the present invention, the terminal 1 is supported in the opening 21 by the supporting part 11 inserted in the through hole 21*a,* and at the same time connected to the substrate by the branched part 14 inserted into through hole 21*b*.

Figure 3:
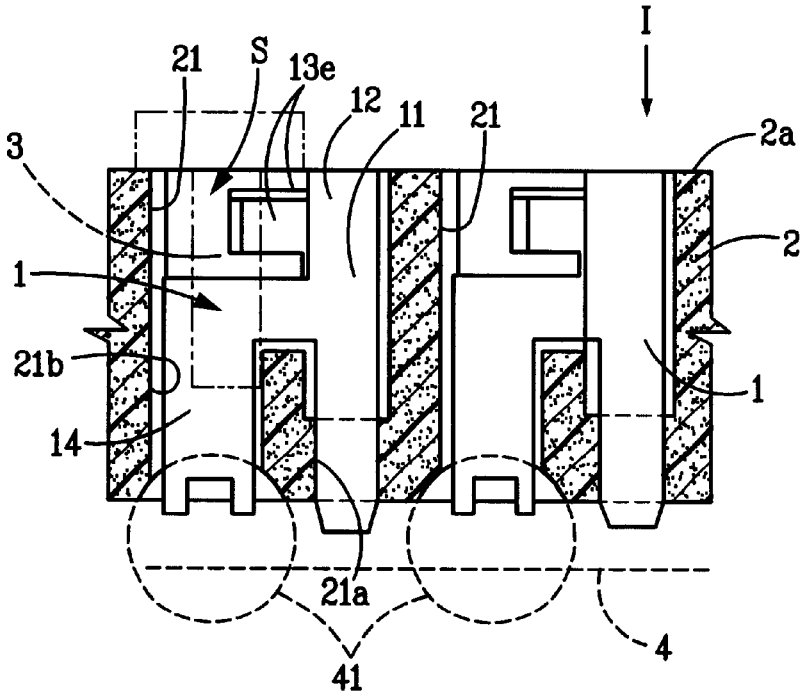
FIG. 3 is a cross-sectional drawing along line III—III in FIG. 2 showing an example of the terminal mounted on the housing according to the present invention.

When installing the electrical part on the housing 2, the electrical part is mounted on the housing 2, and, as shown in FIG. 3 and FIG. 4, the pins 3 are inserted at positions shown by reference symbol R in FIG. 2 into the space S of the corresponding opening 21. Next, when the pins 3 are moved to the other end side, the pin 3 is guided to the engaging part 13 by the guide projections 13*d,* and furthermore, as shown by the reference symbol H in FIG. 2, is grasped between the side parts 13*a* and 13*c* of the engaging part 13 at the opening 13*d,* and as a result, the pin 3 is connected with the terminal 1. In this case, as described above, among the side parts 13*a* and 13*b,* only the side part shown by reference numeral 13*c* is elastically deformed outward, as shown by the arrow M in FIG. 4. When the electrical part is removed, the pin 3 is moved back to the first end side, and after separating the terminal 1 from the pin 3, the pin is extracted form the opening 21.

The terminal 1 in the present invention is supported in the opening 21 by the supporting part 11, and at the same time connected to the substrate via a branched part 14 that branches from the side of the supporting part 11. Therefore, the force for acting on the engaging part 13 when the pin 3 is attached to or removed from the engaging part, and the stress produced in the engaging part 13 due to the elastic deformation of the engaging part 13 are transmitted to the supporting part 11, and are difficult to transmit to the branched part 14. As a result, there is no damage to the connection between the terminal 1 and the substrate 4 due to cracking of the weld that fastens the branched part 14 to the substrate 4.

Furthermore, because the engaging part 13 is formed on the end of the connecting part 12 by bending the end of the supporting part 11, when the engaging part 13 and the pin 3 are engaged, the force acting on the engaging part 13 and the stress produced on the engagement part 13 are absorbed at the connecting part 12, and are directly propagated to the supporting part 11 with difficulty. As a result, the force propagating to the branched part 14 via the supporting part 11 is further reduced. In addition, when grasping the pin 3 in the opening end 13d, because only the side part 13*c* positioned at the side opposite to the connecting part 12 is elastically deformed, among the various stresses produced due to the engagement of the engaging part 13 and the pin 3, the force propagated to the supporting part 11 via the connecting part 12 from the side part 13*a* positioned at the connecting part 12 side is further reduced.

In addition, by the abutment of the surface 11*a* of the supporting part 11 and the wall 21*c* of the opening 2, because the supporting part 11 is supported at the wall 21*c* from the side that is opposite to the curved side of the communicating part 21, there is also the effect that deformation towards the wall 21*c* of the supporting part 11 due to the force received from the connecting part 12 side when the engaging part 13 and the pin 3 are engaged cab be prevented.

Moreover, the specific shape of the terminal 1 and the opening 21 according to the present invention are not limited to those shown in the above-described embodiments, and can be changed in various ways without departing from the gist of the invention.

As explained above, according to the terminal of the present invention, the force acting on the engagement part when the pin is attached to or removed from the engaging part of the terminal and the stress produced on the engaging part due to the elastic deforming of the engaging part is communicated to the supporting part of the terminal, and is communicated to the branched part with difficulty. As a result, according to the terminal of the present invention, the occurrence of defective fastening between the branched part and the substrate due to force propagated to the supporting part and the consequent occurrence of defective connections between the terminal and the substrate are prevented.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A terminal formed in a housing on which an electronic part is mounted, arranged within an opening which receives a pin which projects from said electronic part and which connects with said pin which is inserted into said opening when said electronic part is mounted on said housing; said terminal comprising:

a supporting part for support within said housing;

a connecting part formed by bending the end of said supporting part;

an engaging part formed at the end of said connecting part, said engaging part comprising an opening end which engages said pin and that is misaligned with said connecting part; and a branched part branching from a side of said supporting part and which connects with a substrate on which said housing is supported.

2. A terminal according to claim 1 wherein said connecting part is U-shaped.

3. A terminal according to claim 1 wherein a side surface of said supporting part which is on the opposite side to the side to which said connecting part bends makes contact with a side wall of said opening.

4. A terminal formed in a housing on which an electronic part is mounted, arranged within an opening which receives a pin which projects from said electronic part and which connects with said pin which is inserted into said opening when said electronic part is mounted on said housing; said terminal comprising:

a supporting part for support within said housing;

a connecting part laterally extending from said supporting part;

an engaging part formed at the end of said connecting part and which engages said pin, said engaging part comprising at least two opposing side parts for receipt of said pin therebetween and that are spaced from said supporting part; and a branched part branching from a side of said supporting part and which connects with a substrate on which said housing is supported.

5. A terminal formed in a housing on which an electronic part is mounted, arranged within an opening which receives a pin which projects from said electronic part and which connects with said pin which is inserted into said opening when said electronic part is mounted on said housing; said terminal comprising:

a supporting part for support within said housing;

an engaging part connected to said supporting part and which engages said pin, said engaging part comprising two side parts that contact a portion of said pin;

a branched part branching from a side of said supporting part and which connects with a substrate on which said housing is supported; wherein said two side parts are misaligned with said supporting part.

6. A terminal formed in a housing on which an electronic part is mounted, arranged within an opening which receives a pin which projects from said electronic part and which connects with said pin which is inserted into said opening when said electronic part is mounted on said housing; said terminal comprising:

a supporting part for support within said housing;

a connecting part formed by bending the end of said supporting part;

an engaging part formed at the end of said connecting part, said engaging part comprising at least two opposing side parts for receipt of said pin therebetween; and a branched part branching from a side of said supporting part and which connects with a substrate on which said housing is supported.

7. A terminal according to claim 6 wherein said connecting part is U-shaped.

8. A terminal according to claim 6 wherein a side surface of said supporting part which is on the opposite side to which said connecting part bends makes contact with a side wall of said opening.

* * * * *